US007154463B2

(12) United States Patent
Kwag

(10) Patent No.: US 7,154,463 B2
(45) Date of Patent: Dec. 26, 2006

(54) LIQUID CRYSTAL DISPLAY AND DRIVE METHOD THEREOF

(75) Inventor: Jin-Oh Kwag, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 188 days.

(21) Appl. No.: 09/912,523

(22) Filed: Jul. 26, 2001

(65) Prior Publication Data

US 2002/0015017 A1 Feb. 7, 2002

(30) Foreign Application Priority Data

Jul. 27, 2000 (KR) ..... 2000-43510

(51) Int. Cl.
*G09G 3/36* (2006.01)

(52) U.S. Cl. ..... 345/94

(58) Field of Classification Search ..... 345/53, 345/54, 89, 92, 94, 95, 96, 690; 349/33, 349/172–174

See application file for complete search history.

(56) References Cited

U.S. PATENT DOCUMENTS 5,151,805 A * 9/1992 Takeda et al. ..... 345/94
5,438,342 A * 8/1995 Yamaguchi ..... 345/58
5,784,039 A * 7/1998 Yasui et al. ..... 345/89
5,841,419 A * 11/1998 Maltese ..... 345/97
5,920,298 A * 7/1999 McKnight ..... 345/87
5,995,074 A * 11/1999 Kusafuka et al. ..... 345/90
6,046,790 A * 4/2000 Hara et al. ..... 349/172
6,115,018 A * 9/2000 Okumura et al. ..... 345/95
6,486,864 B1 * 11/2002 Nakajima et al. ..... 345/92

* cited by examiner

*Primary Examiner*—Richard Hjerpe
*Assistant Examiner*—Kevin M. Nguyen
(74) *Attorney, Agent, or Firm*—F. Chau & Assoc., LLC

(57) ABSTRACT

The present invention provides a liquid crystal display comprising: a liquid crystal panel including a plurality of gate lines, a plurality of data lines perpendicularly intersecting the gate lines, a plurality of liquid crystal capacitors coupled to a previous gate line and having liquid crystals between pixel electrodes and a common electrode, and a plurality of thin film transistors connected to the pixel electrodes of the liquid crystal capacitors; a timing controller receiving image signals and synchronization signals, and generating control signals; a gate driver sequentially applying a stepped-wave pattern gate voltage to a plurality of the gate lines, the stepped-wave pattern gate voltage including a first interval for converting a pixel grayscale level of a subsequent gate line formed in a previous frame to a first gray level, and a second interval for forming a path through which data voltage is applied by controlling the thin film transistors to on; and a data driver for applying a data voltage of a second grayscale level supplied to the liquid crystal capacitors of the liquid crystal panel according to the control signals of the timing controller.

22 Claims, 6 Drawing Sheets

LIQUID CRYSTAL DISPLAY AND DRIVE METHOD THEREOF

BACKGROUND OF THE INVENTION (a) Field of the Invention

The present invention relates to a liquid crystal display and a drive method thereof, in which liquid crystal molecules respond fast even at data voltages of an intermediate grayscale level. More particularly, the present invention relates to a liquid crystal display and a drive method thereof, which improves a liquid crystal response speed with respect to the application of a gate voltage of a twisted nematic liquid crystal display.

(b) Description of the Related Art

A twisted nematic liquid crystal display (TN LCD) has the advantages of enabling control at very thin profile configurations, and of consuming very little power. However, the drawbacks of TN LCDs are that they have slow response speeds with respect to applied voltages, and a limited viewing angle.

FIG. 1 shows a graph of response curves when a voltage is applied to pixels of a TN LCD.

As shown in FIG. 1, a response time of twisted nematic liquid crystals is roughly 15–17 ms from the moment a voltage is applied, and when the applied voltage is switched off, a response time of approximately 20 ms is required. Accordingly, it is difficult to realize images containing a large amount of data.

Various configurations are used to improve response speeds. These include the surface stabilized ferroelectric liquid crystal display (SSFLCD) and the anti-ferroelectric liquid crystal display (AFLCD). However, in these LCDs, alignment and the display of grayscale levels are difficult to obtain, and a high reset voltage is required such that practical applications of the LCDs are not fully feasible.

In more traditional configurations, the slow response speeds make the display of certain images (e.g., moving images) unclear since these images require the display of large amounts of grayscale levels during a short interval of time. Therefore, the TN LCD particularly needs an improvement in response speeds.

SUMMARY OF THE INVENTION

The present invention has been made in an effort to solve the above problems.

It is an object of the present invention to provide a liquid crystal display and a drive method thereof in which liquid crystal molecules realize fast response speeds even at data voltages of an intermediate grayscale level.

It is another object of the present invention to provide a liquid crystal display and a drive method thereof in which a response speed of a twisted nematic liquid crystal display is improved.

To achieve the above objects, the present invention provides a liquid crystal display comprising: a liquid crystal panel including a plurality of gate lines, a plurality of data lines perpendicularly intersecting the gate lines, a plurality of liquid crystal capacitors coupled to a previous gate line and having liquid crystals between pixel electrodes and a common electrode, and a plurality of thin film transistors connected to the pixel electrodes of the liquid crystal capacitors; a timing controller receiving image signals and synchronization signals, and generating control signals; a gate driver sequentially applying a stepped-wave pattern gate voltage to a plurality of the gate lines, the stepped-wave pattern gate voltage including a first interval for converting a pixel grayscale level of a subsequent gate line formed in a previous frame to a first grayscale level, and a second interval for forming a path through which data voltage is applied by turning on the thin film transistors; and a data driver for applying a data voltage of a second grayscale level supplied to the liquid crystal capacitors of the liquid crystal panel according to the control signals of the timing controller.

In the liquid crystal display of the present invention, the first grayscale level is a black grayscale level when in a normally white mode, and it is a white grayscale level when in a normally black mode; and the aforementioned gate voltage further includes a third interval for applying a voltage of the same polarity as the data voltage during a predetermined interval before the first interval and following the turning off of the thin film transistors.

In a drive method for a liquid crystal display according to the present invention, with the liquid crystal display including: a liquid crystal panel having a plurality of gate lines, a plurality of data lines perpendicularly intersecting the gate lines, a plurality of liquid crystal capacitors coupled to a previous gate line and having liquid crystals between pixel electrodes and a common electrode, and a plurality of thin film transistors connected to the pixel electrodes of the liquid crystal capacitors; a gate driver for generating a signal supplied to gates of the thin film transistors; and a data driver for generating a data voltage supplied to the liquid crystal capacitors of the liquid crystal panel, the method comprising the steps of: sequentially applying a stepped-wave pattern gate voltage to the gate lines, the stepped-wave pattern gate voltage including a first interval for converting a pixel grayscale level of a subsequent gate line formed in a previous frame to a first grayscale level, and a second interval for forming a path through which data voltage is applied by controlling the thin film transistors to on; and applying a data voltage charged in the liquid crystal capacitors to the liquid crystal panel.

In the drive method for a liquid crystal display according to the present invention, the gate voltage further includes a third interval for applying a voltage of the same polarity as the data voltage during a predetermined interval before the first interval and following the turning off of the thin film transistors.

In the method, the gate voltage in the first interval is identical in polarity to a polarity of the gate voltage in the third interval, it is opposite in polarity to a polarity of the gate voltage in the third interval, the gate voltage in the third interval is ±3V to ±10V relative to a gate-off voltage, and the third interval starts at a point where the second interval ends and it converts to a gate-off voltage at a position where the second interval doubles.

Also in the method, the first grayscale level is a white grayscale level when in a normally black mode, it is a black grayscale level when in a normally white mode, the gate voltage in the first interval is ±3V to ±10V relative to a gate-off voltage, and a starting point of the first interval is within 0.5 μs–5 μs from a starting point of the second interval.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

Preferred embodiments of the present invention will now be described in detail with reference to the accompanying drawings.

Figure 1:
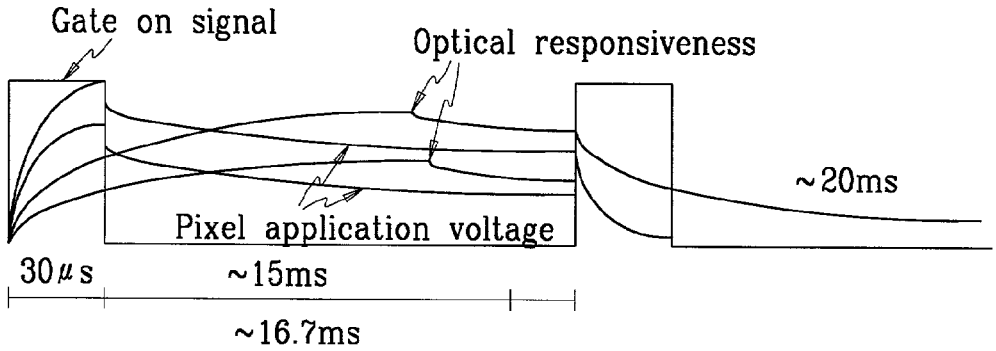
FIG. 1 is a graph of response curves when a voltage is applied to pixels of a TN LCD.
Figure 2:
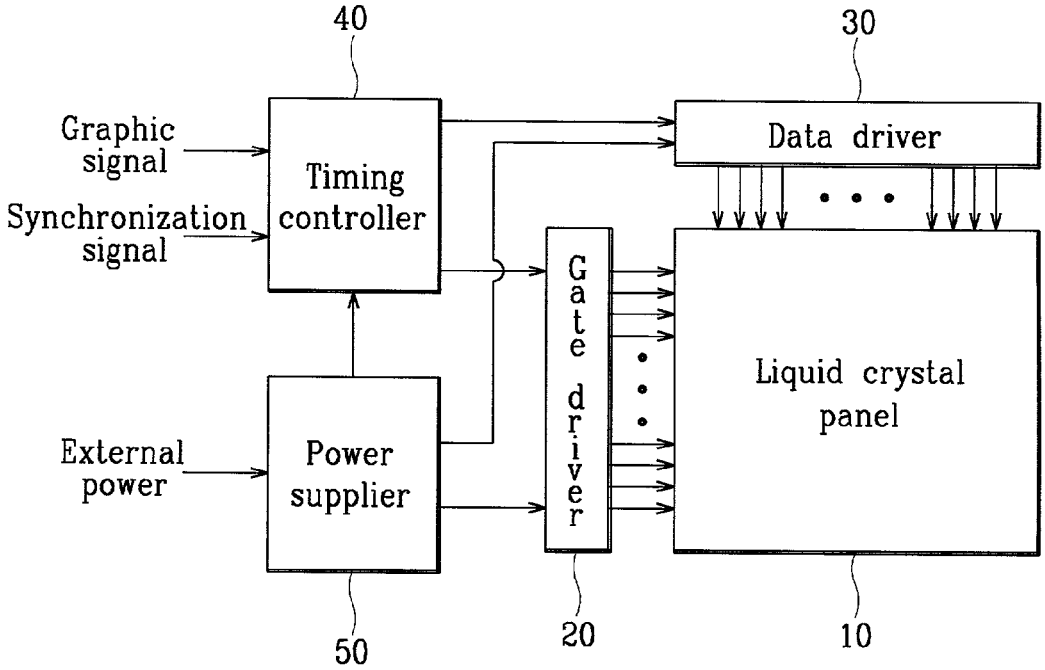
FIG. 2 is a block diagram of a liquid crystal display according to a preferred embodiment of the present invention.

FIG. 2 shows a block diagram of a liquid crystal display according to a preferred embodiment of the present invention.

As shown in FIG. 2, the liquid crystal display includes a liquid crystal panel 10, a gate driver 20, a source driver 30, a timing controller 40, and a power supplier 50. The liquid crystal panel 10 includes a plurality of gate lines, a plurality of data lines perpendicularly intersecting the gate lines, a plurality of thin film transistors, and liquid crystal capacitors connected to the thin film transistors and coupled to the gate lines.

The gate driver 20 is connected to the gate lines of the liquid crystal panel 10 and opens gates to transmit data output from the source driver 30 to be transmitted to pixels. The source driver 30 applies grayscale (bright and dark characteristics of colors) voltages displayed in the pixels to the data lines of the liquid crystal panel 10. The timing controller 40 controls a timing of various signals applied to the liquid crystal panel 10. Finally, the power supplier 50 receives external power and makes various signals that are applied to a plurality of panels.

Figure 3:
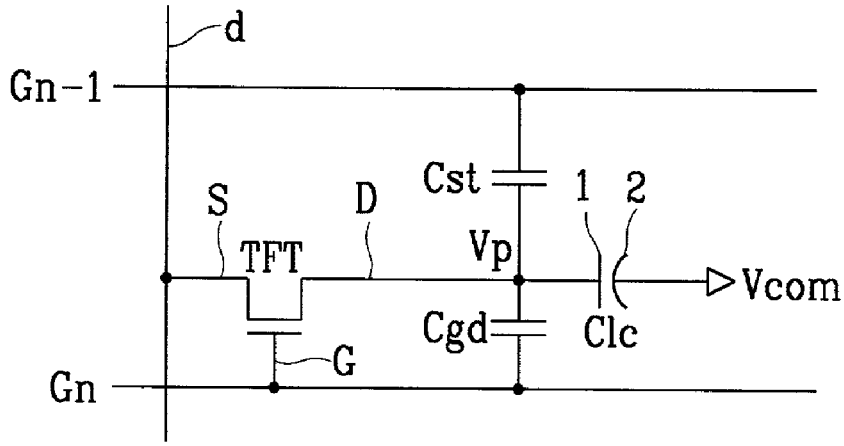
FIG. 3 is an equivalent circuit diagram of a pixel of a liquid crystal display.

In the above, the liquid crystal panel 10 is formed with a previously-described gate structure. This will be described in more detail with reference to FIG. 3, which shows an equivalent circuit diagram of a pixel of a liquid crystal display.

In each of a plurality of pixels formed in a liquid crystal panel 10, there may be formed a liquid crystal capacitor Clc, provided by injecting liquid crystal material between pixel electrodes 1 and a common electrode 2, which is formed opposing the pixel electrodes 1; a thin film transistor (TFT) for applying a pixel voltage to the liquid crystal capacitor Clc via a data line D controlled by a gate line Gn; and a storage capacitor Cst formed in parallel with the liquid crystal capacitor Clc to increase a charge 20 capacitance capability of the liquid crystal capacitor Clc. One end of the storage capacitor Cst is connected to a previous gate Gn-1 to maintain a previous gate voltage in the liquid crystal capacitor Clc.

With this configuration, a liquid crystal application voltage Vp applied to the liquid crystal capacitor Clc is influenced by a data voltage and a gate voltage. Such a drive method in which the liquid crystal application voltage Vp applied to the liquid crystal capacitor Clc is influenced by the gate voltage applied to the previous gate is referred to as capacitively coupled driving (CCD). The present invention utilizes this CCD method.

If expressed in an equation, the liquid crystal application voltage Vp is as shown in Equation 1 below.

Equation 1

$$Vp=\pm Vs+(Cst/(Cst+Cgd+Clc))(Vg(+) \text{ or } Vg(-))$$

where Vs is a pixel voltage, Cgd is a parasitic capacitance, and Vg is a previous gate voltage.

With reference to Equation 1, if a voltage of the same polarity as a data voltage is applied following the application of a gate-on voltage, the pixel voltage changes by the previous voltage Vg after charging is completed.

The principles behind the improvement in response speed of the liquid crystal display of the present invention will now be described with reference to the drawings. Response characteristics when a voltage is applied to twisted nematic liquid crystals will first be described. Then, operations for the improvement of response characteristics will be described.

A response speed when applying a voltage to twisted nematic liquid crystals is as shown in Equation 2 below.

Equation 2

$$\tau_{on}=\gamma/[\epsilon_0\Delta\epsilon E^2-(\pi^2/d^2)KJ$$

where $\tau_{on}$ is a response speed when applying a voltage to liquid crystals, $\epsilon_0$ is an anisotropy in a vacuum state, $\Delta\epsilon$ is a dielectric anisotropy of liquid crystals, E is a liquid crystal application voltage, K is a twisted elasticity coefficient of liquid crystals, d is a distance of a gap between two electrodes (a gap in which liquid crystals are provided), and $\gamma$ is a rotational viscosity coefficient.

As shown by the equation, to improve the response speed $\tau_{on}$ when applying a voltage to liquid crystals, the distance d of the gap, the elasticity coefficient K, the application voltage E, and the dielectric anisotropy $\Delta\epsilon$ must be increased. However, since the rotational viscosity coefficient $\gamma$, the elasticity coefficient K, and the dielectric anisotropy $\Delta\epsilon$ are material constants, it is difficult to change these parameters. On the other hand, the distance d of the gap and the application voltage E are easily changed.

A response speed of liquid crystals when a voltage applied to twisted nematic liquid crystals is controlled to off is as shown in Equation 3 below.

Equation 3

$$\tau_{off}=(\gamma d^2)/(\pi^2 K)$$

As shown in Equation 3, to reduce the liquid crystal response speed when the voltage applied to the liquid crystals is controlled to off, either the distance d of the gap in which the liquid crystals are provided and the rotational viscosity coefficient $\gamma$ must be reduced, or the elasticity coefficient K must be increased. In other words, the liquid crystal response speed when the application voltage turned off cannot be minimized by varying the voltage applied to the liquid crystals.

Figure 4:
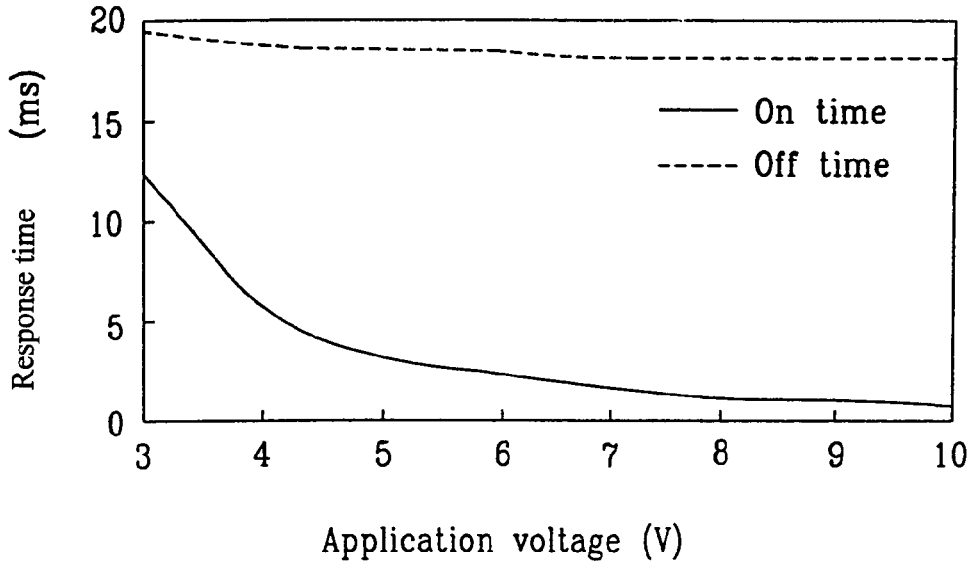
FIG. 4 is a graph showing response speeds when a voltage is applied to twisted nematic liquid crystals and when the voltage is discontinued.

FIG. 4 is a graph showing response speeds when a voltage is applied to twisted nematic liquid crystals and when the voltage is discontinued. In the graph, the horizontal axis is the liquid crystal application voltage, the vertical axis is the liquid crystal response speed in milliseconds, the solid line represents the response speed when a voltage is applied to liquid crystals, and the dotted line represents the response speed when the voltage applied to the liquid crystals is controlled to off.

As shown in FIG. 4, when a voltage is applied to liquid crystals, the response speed is improved with increases in a pixel voltage V. Also, when the voltage applied to the liquid crystals is controlled to off, there is no relationship between the voltage applied to the liquid crystals and response speed.

Accordingly, in a CCD drive method as described with reference to FIG. 2, if following the application of a gate-on voltage, a gate voltage is increased in the same polarity as a data voltage, the liquid crystal response speed is improved. However, in the CCD drive method, as can be known from Equation 1, the larger the degree of capacitance variations, the greater the improvements in liquid crystal response speed. But since the degree of capacitance variations is small between intermediate grayscale levels, a big improvement in response speed is not achieved.

To increase the degree of capacitance variations in the present invention, a grayscale level of liquid crystals is changed to black or white before applying the pixel voltage such that the change in the amount of liquid crystal capacitance is large also in intermediate grayscale levels, thereby obtaining improved response speeds of the liquid crystals. This will be described in more detail below.

Figure 7A:
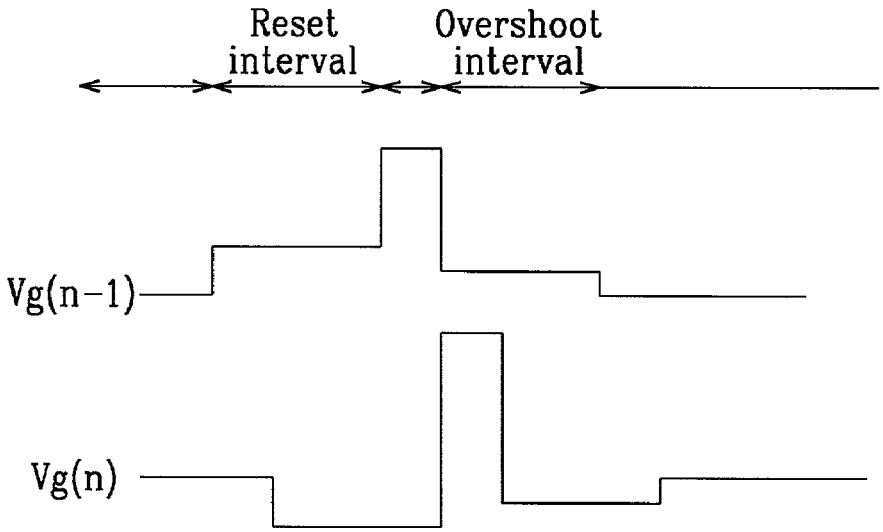
FIGS. 7A and 7B are waveform diagrams of a gate voltage according to a preferred embodiment of the present invention.
Figure 7B:
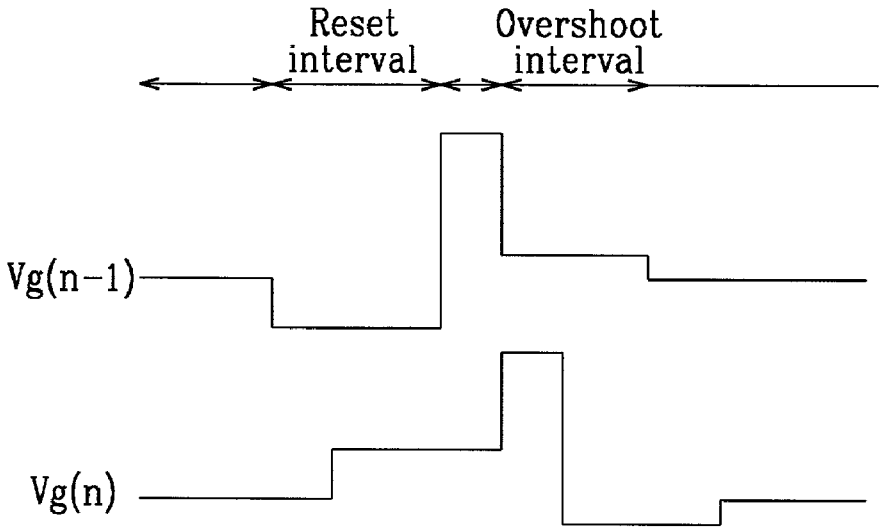

First, in the present invention, a gate signal is generated having a reset interval, a gate-on interval, and an overshoot interval as shown in FIGS. 7A and 7B such that the liquid crystals are changed to a black or white grayscale level at a previous gate before the gate-on voltage is applied. In the reset interval, the liquid crystals of a subsequent gate line are reset to a black or white grayscale level. In the gate-on interval, the thin film transistors are controlled to on. In the overshoot interval, the liquid crystal application voltage of a subsequent gate line is overshot to improve the liquid crystal response speed.

In FIG. 7A, examples of a previous gate voltage Vg(n−1) and a subsequent gate voltage Vg(n) are shown to describe waveform diagrams of a gate voltage for changing liquid crystals to a black grayscale level in a previous gate before the gate-on voltage is applied. In the gate voltage waveform of FIG. 7A, application is performed during a normally white mode, a polarity of the reset interval and overshoot interval are the same, and a polarity of the two intervals is equal to that of a data voltage applied to the liquid crystals of a present gate line. Accordingly, if a gate voltage as in FIG. 7A is applied, a liquid crystal application voltage Vp of a subsequent gate voltage is increased in a ±direction during the reset interval to result in a black grayscale level, after which a target grayscale level is realized in the gate-on interval.

In FIG. 7B, examples of a previous gate voltage Vg(n−1) and a subsequent gate voltage Vg(n) are shown to describe waveform diagrams of a gate voltage for changing liquid crystals to a white grayscale level in a previous gate before the gate-on voltage is applied. In the gate voltage waveform of FIG. 7B, application is performed during a normally black mode, a polarity of the reset interval and overshoot interval are opposite, and a polarity of the overshoot interval is equal to that of a data voltage applied to the liquid crystals of a present gate line. Accordingly, if a gate voltage as in FIG. 7B is applied, a liquid crystal application voltage Vp of a subsequent gate voltage is decreased in a ±direction during the reset interval to result in a black grayscale level, after which a target grayscale level is realized in the gate-on interval.

This is expressed in Equation 4 below.

Equation 4

$$Vp=\pm Vs+[Cst/(Cst+Cgd+Clc)](Vgccd(+) \text{ or } Vgccd(-))+[Cst/(Cst+Cgd+Clc)](Vgreset(+) \text{ or } Vgreset(-))$$

where Vgccd(+) and Vgccd(−) are voltages induced by the previous gate voltage, and Vgreset(+) and Vgreset(−) are gate voltages for facilitating changes to a black or white grayscale level.

If, as in FIGS. 7A and 7B, a corresponding voltage is applied to the pixels during the reset interval such that the grayscale level of the pixels is controlled to a minimum (white) or maximum (black) grayscale level, even with the subsequent opening of the thin film transistors such that the pixels come to be in an intermediate grayscale level, changes in grayscale level, or changes in the liquid crystal capacity Clc, increase and the response speed of liquid crystals increases in turn.

A drive method of a liquid crystal display for improving a response speed of liquid crystals according to a preferred embodiment of the present invention will now be described with reference to FIGS. 5 and 6.

Figure 5:
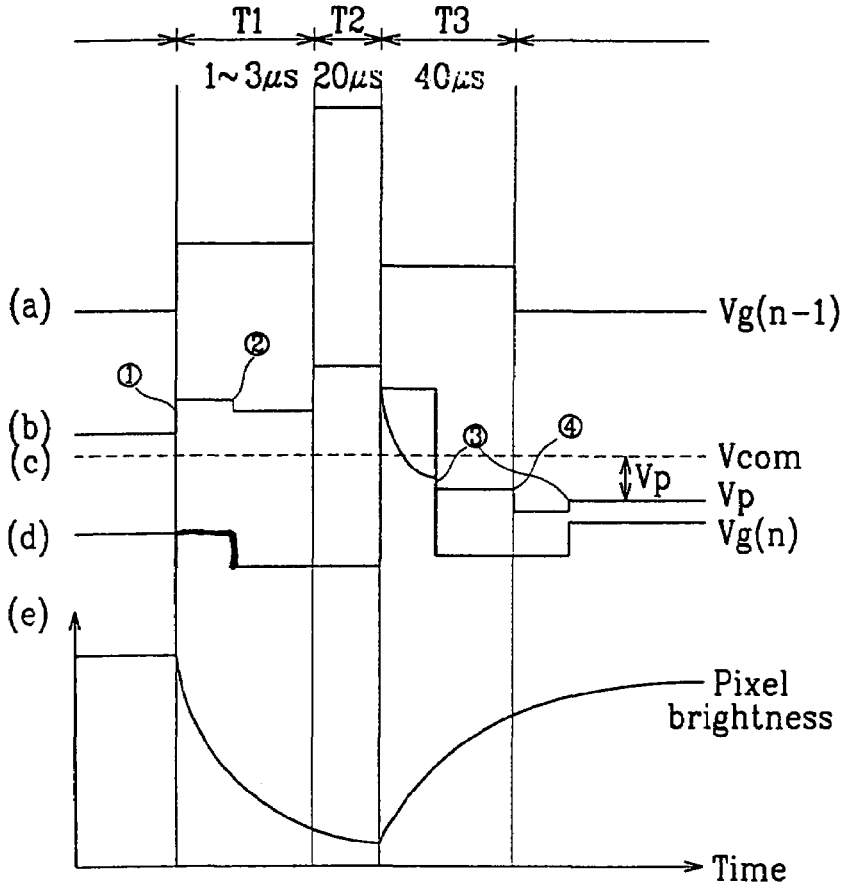
FIG. 5 is a graph showing a gate signal for driving liquid crystals and voltages that are charged in actual pixels and that vary according to the gate signal according to a preferred embodiment of the present invention.
Figure 6:
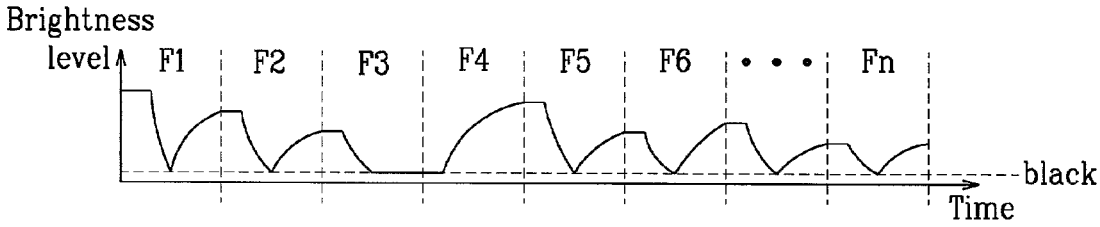
FIG. 6 is a graph showing response characteristics of liquid crystals when a step-wave gate voltage is applied according to a preferred embodiment of the present invention.

FIG. 5 is a graph showing a gate signal for driving liquid crystals and voltages that are charged in actual pixels and that vary according to the gate signal according to a preferred embodiment of the present invention. The case of voltage application to a normally white mode is shown in the drawing.

In FIG. 5, (a) is a previous gate voltage Vg(n−1), (b) is a subsequent gate voltage Vg(n), (c) is a common voltage Vcom, (d) is a voltage Vp applied to an actual pixel, (e) is a brightness of liquid crystals, T1 is a reset interval, T2 is a gate-on interval, and T3 is an overshoot interval.

A gate voltage such as (a) applied to a previous gate line (n−1) is applied when a data voltage, which is applied via a thin film transistor that is connected to the previous gate line (n−1), is of a positive polarity. Further, a gate voltage such as (d) applied to an n gate line is applied when a data voltage, which is applied via a thin film transistor that is connected to the n gate line, is of a negative polarity.

Here, the pixel of the $(n-1)^{th}$ gate forms a grayscale level of a negative polarity by a previous frame, and the pixel of the $(n)^{th}$ gate forms a grayscale level of a positive polarity. Therefore, if a gate voltage of (a) is applied (T1 interval), the pixel voltage of the $(n)^{th}$ gate is increased by a predetermined amount in a positive direction, and a degree of increase of the same is further increased by a gate-on voltage of (a) (T2 interval). This results in the pixel of the $(n)^{th}$ gate being reset to black.

Further, the gate-on voltage of (d) is applied to the $(n)^{th}$ gate at the same time as the completion of the gate-on interval (T2 interval) of (a) such that the gate voltage of a negative polarity is applied to the pixel. Accordingly, the liquid crystal application voltage Vp is reduced and comes to assume a negative polarity. Hence, the liquid crystal application voltage Vp varies greatly from a positive polarity to a negative polarity. This results in a large variation in capacitance by the relationship C (capacitance)=Q (capacity)/Vp.

In the above, by changing the pixels to a black or white grayscale level before the application of a data voltage, a large change in capacitance is realized. As a result, the response of liquid crystals is improved between intermediate grayscale levels.

In the overshoot interval T3 following the T2 interval, a previous gate voltage is applied for a predetermined interval and to the same polarity as the data voltage after the thin film transistor of the $(n)^{th}$ gate is turned off. Accordingly, the liquid crystal voltage Vp is changed to the polarity direction of the data voltage such that in the response speed improves when the thin film transistor is off.

As a result, a waveform V1 of the voltage Vp formed in the actual liquid crystals, with reference to (b) of FIG. 5, increases a predetermined amount in proportion to the increases in the level of the previous gate voltage Vg(n−1), decreases by a predetermined amount by a kickback of the parasitic capacitance Cgd, then increases in proportion to the previous gate-on signal.

The voltage of the T1 interval (reset interval) determines the speed at which the grayscale level of a subsequent pixel changes to a black grayscale level. If, as shown in FIG. 4, this voltage is set to 5V, the response time of the liquid crystals is approximately 4 ms, while if set to 10V, the response time is less than 1 ms. That is, there is a direct relationship between the voltage level in the T1 interval and response speed. However, at a certain level of voltage, the thin film transistors may leak, resulting unfavorable conditions of applying of the data voltage to other pixels.

Therefore, it is preferable that the voltage in the T1 interval be designed with this problem in mind. Here, voltage inducement through the storage capacitor Cst is related to the ratio of storage capacitance Cst to liquid crystal capacitance Clc (Cgd can be ignored since it is relatively small), and the smaller this ratio of storage capacitance Cst to liquid crystal capacitance Clc is, the better the voltage changes of the previous gate are transmitted to the pixels through the storage capacitor Cst.

However, since in actual practice, the storage capacitance and liquid crystal capacitance are almost identical to increase VHR, approximately ½ to ¼ of the previous gate voltage changes are induced in the pixels. As a result, if the gate-off voltage changes 10V, between 2.5 and 5V are applied to the pixels. Therefore, it is preferable that the gate voltage in the T1 interval and the T3 interval varies in the range of ±3V to ±10V.

Equation 4 is used to determine the pixel application voltage Vp for the black and white grayscale levels. The anisotropy of the liquid crystals is (ϵ□=10.8, ϵ⊥□=3.4?), and Cst ~Clc (the liquid crystal state in the case where voltage is not applied, that is a state where the pixels are designed so that ϵ=ϵ⊥□).

1. Black grayscale level

If Vs=4V, Vgccd=10V, Vgreset=10V, and Cgd=0, Vp=4V+¼×10V+¼×10V=9V.

2. White grayscale level

Vp=2V+½×10V+½10V=12V.

Therefore, the white grayscale level, a high voltage is automatically applied to enable a faster drop compared to black, and a low voltage is applied in black. Accordingly, with respect to FIG. 5, if a voltage of 10V or higher is applied, a response speed of less than 1 ms is obtained, and if high-speed liquid crystals are used, a reset of less than 0.5 ms is possible.

In the liquid crystal display and drive method of the present invention described above, before the application of the data voltage, the grayscale level formed by a previous frame is changed to black or white such that the response speed between intermediate grayscale levels is improved. As a result, the liquid crystal display is capable of more quickly and accurately processing large amounts of image data.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A liquid crystal display (LCD), comprising:

a plurality of gate lines;

a plurality of data lines intersecting the gate lines;

a data driver generating data voltages for the data lines; and a gate driver generating stepped-wave pattern gate signals for the gate lines, each stepped-wave pattern gate signal including;

a reset interval for converting a grayscale level of a pixel corresponding to a subsequent gate line to an extreme grayscale level;

a gate-on interval following the reset interval; and an overshoot-interval following the gate-on interval and having the same polarity with a data voltage applied to the pixel.

2. The liquid crystal display of claim 1, wherein the first grayscale level is a black grayscale level when in a normally white mode.

3. The LCD of claim 1, wherein the extreme grayscale level in a normally black mode.

4. A drive method for a liquid crystal display (LCD), comprising:

sequentially applying stepped-wave pattern gate signals to the gate lines, each stepped-wave pattern gate signal comprising:

a reset interval converting a grayscale level of a pixel corresponding to a subsequent gate line to an extreme grayscale level, a gate-on interval following the reset interval, and an overshoot interval following the gate-on interval and having the same polarity with a data voltage applied to the pixel; and applying the data voltage to the pixel.

5. The method of claim 4, wherein the gate signal in the reset interval has the same polarity with the gate signal in the overshoot interval.

6. The method of claim 4, wherein the gate signal in the reset interval has a different polarity from the gate signal in the overshoot interval.

7. The method of claim 4, wherein a voltage level of the gate signal in the overshoot interval is +3V to +10V relative to a gate-off voltage.

8. The method of claim 4, wherein the overshoot interval starts when the gate-on interval ends, and converts to a gate-off voltage when the gate-on interval doubles.

9. The method of claim 4, wherein the extreme grayscale level is a white grayscale level in a normally black mode.

10. The method of claim 4, wherein the extreme grayscale level is a black grayscale level in a normally white mode.

11. The method of claim 4, wherein a voltage level of the gate signal in the reset interval is +3V to +10V relative to a gate-off voltage.

12. The method of claim 4, wherein the reset interval starts about 0.5 μs after the gate-on interval starts.

13. A liquid crystal (LCD), comprising:

a gate driver generating a gate signal;

a data driver generating a first data voltage and a second data voltage;

a first gate line transmitting the gate signal;

a second gate line neighboring the first gate line and transmitting the gate signal;

a data line intersecting the first and second gate lines and transmitting the first data signal and the second data signal;

a first switching element connected to the first gate line and the data line and selectively transmitting the first data voltage to a first pixel;

a second switching element connected to the second gate line and the data line and selectively transmitting the second data voltage to a second pixel;

a first liquid crystal capacitance formed at the first pixel;

a second liquid crystal capacitance formed at the second pixel;

a storage capacitance formed between the second liquid crystal capacitance and the first gate line;

wherein the gate signal applied to the first gate line has a first interval having a first voltage converting a grayscale level of the second pixel to an extreme grayscale level, a second interval following the first interval and having a second voltage, a third interval following the second interval and having a third voltage and a fourth interval following the third interval and having a fourth voltage.

14. The LCD of claim 13, wherein the first switching element is turned on by the second voltage and turned off by the fourth voltage.

15. The LCD of claim 14, further comprising a common line providing a common voltage for the first liquid crystal capacitance and the second liquid crystal capacitance, wherein the third voltage of the gate signal applied to the first gate line is greater than the fourth voltage when the first data voltage is higher than the common voltage, and the third voltage of the gate signal applied to the first gate line is lower than the fourth voltage when the first data voltage is less than the common voltage.

16. The LCD of claim 15, wherein both the first and the third voltages are higher or lower than the fourth voltage.

17. The LCD of claim 16, wherein the liquid crystal display operates in a normally white mode.

18. The LCD of claim 15, wherein one of the first and the third voltages is greater than the fourth voltage and the other is less than the fourth voltage.

19. The LCD of claim 18, wherein the liquid crystal display operates in a normally black mode.

20. The LCD of claim 14, wherein both the first and the third voltages are higher or lower than the fourth voltage.

21. The LCD of claim 20, wherein a level of the third voltage is between levels the first voltage and the fourth voltage.

22. The LCD of claim 14, wherein one of the first and the third voltages is greater than the fourth voltage and the other is less than the fourth voltage.

* * * * *